United States Patent [19]

Grunder

[11] Patent Number: 4,509,703

[45] Date of Patent: Apr. 9, 1985

[54] METHOD AND APPARATUS FOR TRANSPORTING AND STORING PARTIALLY OVERLAPPING SHEETS

[75] Inventor: Roland Grunder, Vordemwald, Switzerland

[73] Assignee: Grapha-Holding AG, Hergiswil, Switzerland

[21] Appl. No.: 489,261

[22] Filed: Apr. 27, 1983

[30] Foreign Application Priority Data

May 5, 1982 [CH] Switzerland ..... 2755/82

[51] Int. Cl.[3] ..... B65H 29/28; B65H 33/14; B65H 5/00; B65H 1/00

[52] U.S. Cl. ..... 242/59; 53/118; 53/430; 198/347; 271/184; 271/204; 271/216; 271/225

[58] Field of Search ..... 242/59, 55; 53/118, 53/430; 271/3, 3.1, 9, 184, 186, 187, 204, 207, 216, 225, 277; 194/DIG. 26; 198/347

[56] References Cited

U.S. PATENT DOCUMENTS

| | | | |
|---|---|---|---|
| 3,549,145 | 12/1970 | Troutmann | 271/184 |
| 3,658,322 | 4/1972 | Martin | 271/184 |
| 4,201,377 | 5/1980 | Honegger | 271/225 |

FOREIGN PATENT DOCUMENTS 2081230 2/1982 United Kingdom .

*Primary Examiner*—Stuart S. Levy
*Assistant Examiner*—Lloyd D. Doigan
*Attorney, Agent, or Firm*—Peter K. Kontler

[57] ABSTRACT

Successive sections of a long stream of partially overlapping paper sheets are transferred onto the upper side of a relatively wide flexible elastic band which is indexed stepwise so that it is gradually withdrawn from a first reel and wound onto a second reel. Each section has two or more partially overlapping sheets, and successive sections can be deposited on the band in such a way that they partially overlap one another, i.e., that the band supports and confines between its windings a scalloped stream consisting of partially overlapping sections of partially overlapping sheets. In order to remove the stored sheets, the conveyor which is used to transfer sections of the scalloped stream onto the band is used to remove successive sections from the band while the latter is driven stepwise to be withdrawn from the second reel and wound back onto the first reel. The thus removed sections are deposited onto the upper reach of a receiving conveyor, either by individually depositing successive sheets of a section or by simultaneously depositing the sheets of a complete section. The sheets on the receiving conveyor can form a continuous scalloped stream or a series of discrete sections of an interrupted scalloped stream.

17 Claims, 2 Drawing Figures

METHOD AND APPARATUS FOR TRANSPORTING AND STORING PARTIALLY OVERLAPPING SHEETS

BACKGROUND OF THE INVENTION

The present invention relates to a method and apparatus for temporarily storing single or multipanel sheets, e.g., printed sheets which are to be transported to a gathering or like machine. More particularly, the invention relates to improvements in a method and apparatus for temporary storage of sheets between the windings of a band or an analogous flexible carrier which is wound around the core of a reel or an analogous support.

It is already known to store the sheets of a scalloped stream of sheets (namely, a stream wherein the trailing portion of each preceding sheet is overlapped by the leader of the next-following sheet) between the windings of a flexible carrier by winding the carrier onto the core of a reel while the sheets of the scalloped stream are fed onto the upper side of that portion of the carrier which is about to be converted into the outermost winding on the core of the reel. The carrier can confine long sections of the scalloped stream. Reference may be had to the commonly owned copending patent application Ser. No. 389,981 filed June 18, 1982, by Hans Thierstein.

In order to remove the stored sheets, the section which is stored between the windings of the carrier is caused to advance through an inverting station. The sheets are thereupon fed to a removing conveyor or the like by delivering the rearmost sheet of the section first and so forth. The width of the carrier approximates or is even less than the width of a sheet. It has been found that, even though such apparatus are capable of storing relatively large numbers of sheets, their capacity is still below an optimum capacity such as would ensure that each magazine can satisfy the needs of a consuming or processing machine for an extended period of time.

OBJECTS AND SUMMARY OF THE INVENTION

An object of the invention is to provide a novel and improved method of temporarily storing partially overlapping sheets of paper or the like in a small area and in such quantities that the stored supply can meet the requirements of modern high-speed consuming or processing machines for suprisingly long intervals of time.

Another object of the invention is to provide a novel and improved method of temporarily storing partially overlapping sheets or groups of sheets of paper or the like between the windings of a flexible carrier which is adapted to be wound onto or unwound from the core of a reel.

A further object of the invention is to provide a novel and improved method of removing the stored sheets from between the windings of the carrier.

An additional object of the invention is to provide a novel and improved apparatus for the practice of the above outlined method.

Still another object of the invention is to provide the apparatus with novel and improved means for transferring sheets onto and for removing sheets from the flexible carrier.

A further object of the invention is to provide the apparatus with a novel and improved flexible carrier whose sheet-storing capacity is a multiple of that of heretofore known carriers even though the length of the improved carrier need not exceed the length of a conventional carrier.

An additional object of the invention is to provide a magazine which can be used in the improved apparatus for temporary storage of large numbers of paper sheets or the like without defacing, creasing and/or otherwise damaging the sheets prior to and during storage as well as during withdrawal of sheets from temporary storage.

One feature of the invention resides in the provision of a method of temporarily storing the sheets of a stream of partially overlapping sheets, each of which has a predetermined width, between the windings of a flexible carrier which has a predetermined width, which is convoluted onto the core of a first reel and whose leader is attached to the core of a second reel. The method comprises the steps of transporting the stream of partially overlapping sheets lengthwise along a predetermined path which extends transversely of the carrier intermediate the first and second reels, transferring from such path successive stream sections each of which has a length at most matching the width of the carrier and each of which contains several partially overlapping sheets, depositing successive sections on the carrier between the first and second reels, and advancing the carrier stepwise in a direction from the first toward the second reel upon transfer of successive sections of the stream so that the carrier is wound onto the core of the second reel and the sections of the stream are confined between the neighboring windings of the carrier. The advancing step preferably comprises moving the carrier through increments whose length at most equals and can be less than the width of a sheet so that the successively transferred sections partially overlap each other on the carrier and between the windings surrounding the core of the second reel. The predetermined path can be at least substantially horizontal, and the method can further comprise the step of maintaining a portion of the carrier between the two reels in an at least substantially horizontal plane at a level below the path of the stream. The sections are deposited onto such portion of the carrier.

The method can further comprise the steps of moving the carrier stepwise in a direction from the second reel toward the first reel, and removing successive sections from the carrier between the first and second reels during the intervals between successive stepwise movements of the carrier in the direction from the second toward the first reel.

Another feature of the invention resides in the provision of an apparatus for temporarily storing the sheets of a stream of partially overlapping sheets. The apparatus comprises a first and a second reel, an elongated flexible carrier whose end portions are secured to the two reels so that the carrier is wound onto the second reel when the first and second reels are rotated in directions to respectively pay out and collect the carrier, conveyor means which serves to transport the stream lengthwise along a predetermined path extending transversely of the carrier between the two reels, means for transferring successive stream sections, each of which has a length at most equal to the width of the carrier and each of which contains two or more partially overlapping sheets, from the predetermined path onto the carrier between the two reels, and means for advancing the carrier stepwise between the transfer of successive stream sections and in a direction from the first toward the second reel so that the carrier is wound onto the second reel and the sections of the stream are confined between the neighboring windings of the carrier. The apparatus preferably further comprises guide means (e.g., suitable guide rolls) which defines for the carrier a second path intermediate the two reels and at a level below the predetermined path. The transferring means preferably comprises second conveyor means extending substantially transversely of the carrier between the two reels and having a length which at least matches the width of the carrier. Such second conveyor means can comprise at least one pair of open-and-shut grippers for each sheet of a section. The second conveyor means is preferably installed adjacent to that side of the predetermined path which is remote from the second reel. The second conveyor means is constructed and assembled to deposit successive sections of the stream on that portion of the carrier which is located in the second path. The apparatus can further comprise sheet removing conveyor means which can receive successive sections of the stream from the carrier portion in the second path in response to stepwise unwinding of the carrier from the second reel.

The advancing means is preferably designed to move the carrier through increments of a length less than or at most equal to the width of a sheet so that the successively transferred sections of the stream partially overlap each other on the carrier intermediate the two reels as well as between the windings of the carrier on the second reel.

The carrier preferably consists of or contains rubber or other suitable elastomeric material so that it can be expanded and contracted lengthwise.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
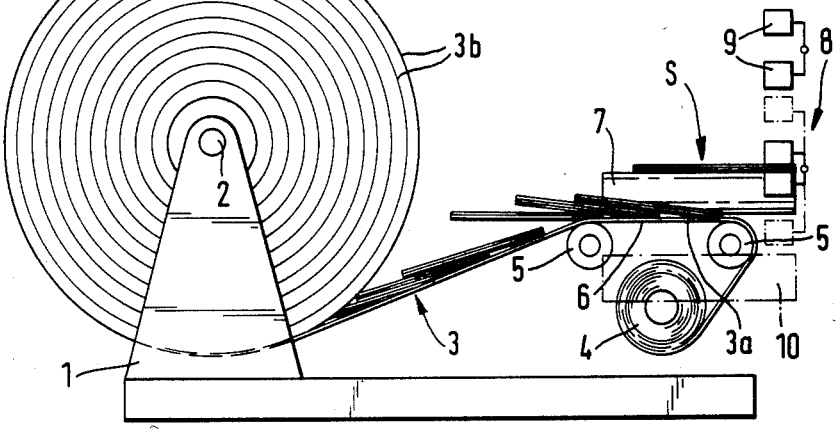
FIG. 1 is a schematic side elevational view of an apparatus which embodies one form of the invention and is in the process of storing the sections of a continuous or elongated stream of partially overlapping sheets.

The apparatus which is shown in the drawing comprises a first reel 4 whose core is surrounded by the windings of an elongated flexible elastically extensible and contractible carrier in the form of a relatively wide belt or band 3. One end portion of the carrier 3 is attached to the core of the reel 4 and the other end portion of the carrier is attached to the core or hub of a second reel 2 which is mounted between two upstanding bearing members 1 carried by a base 1*a*. When the core of the second reel 2 is rotated in a clockwise direction, as viewed in FIG. 1, successive portions of the carrier 3 are wound onto the second reel while the first reel 4 rotates in a counterclockwise direction in order to pay out the carrier. The means for advancing the carrier 3 stepwise in a direction from the reel 4 toward the reel 2 or vice versa comprises a reversible electric motor M which is shown schematically in the upper left-hand portion of FIG. 2. A first braking device (not shown) can be provided to yieldably oppose rotation of the first reel 4 while the second reel 2 collects the carrier 3, and a second braking device can be provided to yieldably oppose rotation of the reel 2 in a counterclockwise direction while the reel 4 collects the carrier 3 on its core.

An intermediate portion 3*a* of the carrier 3 is trained over two guide rolls 5 so that it is located in a substantially horizontal plane and has a width at least equaling the width W of one of a long series of sheets P forming part of a continuous or elongated scalloped stream S whose sheets partially overlap each other in such a way that the trailing portion of each preceding sheet is overlapped by the leader of the next-following sheet. The stream S is supplied by an endless chain or belt conveyor 7 which is driven to advance the stream S lengthwise in a direction transversely of the carrier 3 between the reels 2, 4 and along a horizontal path disposed at a level above the path of the carrier portion 3*a* between the guide rolls 5

Figure 2:
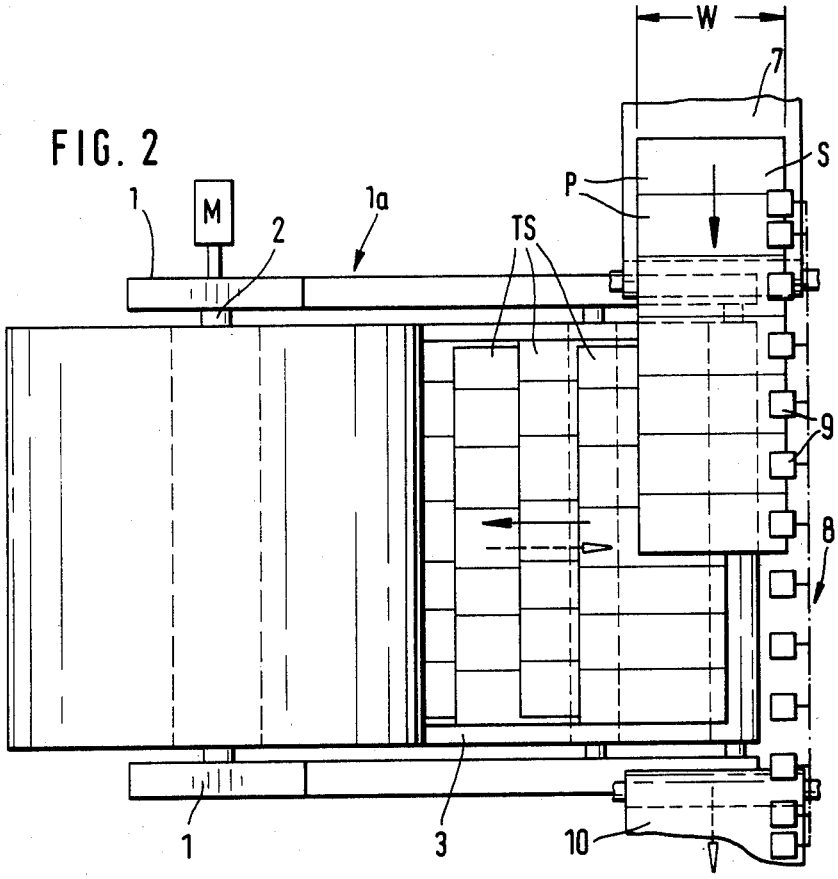
FIG. 2 is a plan view of the structure which is illustrated in FIG. 1, and further showing a sheet removing conveyor which can be used to receive sections of the stream from the carrier.

The carrier portion 3*a* between the guide rolls 5 defines a transfer zone 6 where the upper side of the carrier 3 receives successive sections TS of the scalloped stream S. The discharge end of the conveyor 7 is located close to and upstream of the zone 6, as considered in the direction of travel of the stream S. The means for transferring successive sections TS of the stream S onto the carrier portion 3*a* between the guide rolls 5 comprises a second conveyor 8 having pairs of open-and-shut grippers 9 and being trained over pulleys, sprocket wheels or analogous elements so as to advance the grippers 9 along an endless path disposed at that side of the path for the stream S which is remote from the reel 2. The grippers 9 can be opened in certain portions of the endless path which is defined therefor by the conveyor 8 so that they receive portions of the adjacent sheets P on the conveyor 7. The grippers 9 thereupon close and advance the thus engaged sheets P to a position at a level above the carrier portion 3*a* to open at an appropriate instant in order to drop a full section TS of the stream S onto the upper side of the carrier. The same procedure is repeated again and again so that successive portions of the carrier 3 (which is advanced stepwise by the motor M to move in a direction from the reel 4 toward the reel 2 and to be convoluted onto the core of the reel 2) accumulate a succession of stream sections TS as shown in FIG. 2. The length of successive steps which are performed by the carrier 3 is preferably less than or at most matches the width W of a sheet P so that the carrier accumulates a scalloped stream of stream sections TS, i.e., a stream of portions of the original scalloped stream S. The length of each section TS at most equals the width of the carrier 3, and each section TS consists of two or more partially overlapping sheets P. The number of sheets P in each section or partial stream TS is determined by the number of gripper pairs which open simultaneously at a level above the carrier portion 3*a* so that the latter can intercept a corresponding number of descending sheets P which continue to partially overlap one another. The means for opening the grippers 9 in predetermined portions of the path which is defined by the conveyor 8 (first to permit the adjacent marginal portions of the sheets P to enter the opened grippers and thereupon to enable the grippers to simultaneously release a section TS of the stream S) can comprise suitable stationary cam means which are adjacent to the path of the grippers 9 and can open the oncoming grippers against the opposition of suitable springs (not shown) which serve to ensure that the sheets P are properly held by the respective grippers during transfer from the path which is defined by the upper reach of the conveyor 7 into the path which is defined by the carrier portion 3*a*. A conveyor which can be used to transfer sheets from the conveyor 7 onto the carrier portion 3*a* is manufactured and sold by the firm Devario AG, Zurich, Switzerland.

The motor M drives the carrier 3 stepwise by rotating the reel 2 in a clockwise direction, as viewed in FIG. 1. Thus, the carrier 3 is gradually converted into a series of windings 3*b* which surround the core of the reel 2. Successive windings 3*b* of the carrier 3 confine the scalloped stream which consists of the sections TS. Such mode of storing sheets has been found to allow for storage of a large number of sheets in a small area as well as for convenient and rapid access to the stored sheets. If desired, the indexing of the reels 2 and 4 in a direction to cause the carrier 3 to form windings 3*b* on the core of the reel 2 can be such that successive sections TS merely abut each other or are entirely out of contact while supported by the carrier and while confined between the windings 3*b* which surround the core of the reel 2.

The conveyors 7 and 8 can be driven continuously or stepwise, and their movements are synchronized in such a way that the grippers 9 can engage and entrain each and every sheet P of the stream S. Indexing of the reel 2 in a clockwise direction alternates with the deposition of successive sections TS on the carrier portion 3*a* between the guide rolls 5 with the result that (if the steps are shorter than the width W of a sheet P) the sections TS of the stream S partially overlap one another. Such sections are securely held between the neighboring windings 3*b* because the carrier 3 is preferably wound in an at least slightly stretched condition so that the windings 3*b* are in requisite frictional engagement with the sheets P and prevent the sections TS from moving with reference to one another while such sections are confined in the magazine which is constituted by the reel 2 and the windings 3*b* of the carrier 3. The formation of a scalloped stream of partially overlapping sections TS on the carrier 3 is terminated when the stream S is exhausted or when the supply of convoluted carrier material on the core of the first reel 4 is exhausted, i.e., when the entire carrier (with the exception of its rearmost portion extending from the outermost winding 3*b* to the core of the reel 4) is convoluted onto the core of the reel 2. The exact number of stored sheets P in the magazine including the reel 2 and the windings 3*b* depends on the extent to which the neighboring sheets of the stream S overlap each other and on the width of the carrier; as mentioned above, such width suffices to ensure that each partial stream or section TS contains at least two but preferably three or more sheets. Furthermore, the number of sheets which can be temporarily stored in the magazine depends on the extent to which the neighboring sections TS overlap each other, i.e., on the ratio of the length of steps which are performed by the carrier 3 to the width W of the sheets P.

The improved apparatus further comprises a sheet removing or receiving conveyor 10 which is located downstream of the zone 6, as considered in the direction of transport of sheets P by the conveyor 7. The length of the conveyor 8 is selected in such a way that its grippers 9 can be used to transfer successive sections TS from the carrier portion 3*a* onto the upper reach of the preferably endless (belt or chain) conveyor 10 by reversing the aforediscussed procedure, i.e., by driving the motor M stepwise in a direction to rotate the first reel 4 clockwise and to cause the second reel 2 to pay out the windings 3*b* of the carrier through increments or steps of the same length as during filling of the magazine with sections TS. The conveyor 10 can be driven in stepwise fashion and comes to a halt whenever the grippers 9 of the conveyor 8 open thereabove so as to drop a full section TS or discrete sheets P onto the conveyor 10. The upper reach of this conveyor is disposed in a preferably horizontal plane at a level below the path which is defined by the carrier portion 3*a*. The conveyor 8 is movable up and down, either in its entirety or in part, so that it can descend preparatory to transfer of sections TS from the upper side of the carrier portion 3*a* onto the upper reach of the receiving conveyor 10. The latter is held at a standstill and those grippers 9 which are adjacent to the zone 6 are open while the carrier 3 is moved by a step in a direction from the reel 2 toward the reel 4 whereby the right-hand marginal portions of the sheets P forming the foremost (rightmost) section TS on the carrier portion 3 automatically enter between the jaws of the opened grippers 9. The grippers 9 are thereupon closed or permitted to close, and the conveyor 8 is set in motion to transfer an entire section TS from the zone 6 onto the upper reach of the conveyor 10. Alternatively, the conveyor 10 is held at a standstill until the foremost sheet P of a freshly removed section TS reaches the adjacent end portion of the upper reach of the conveyor 10. The corresponding grippers 9 are then opened so that the thus released foremost sheet P descends onto the conveyor 10 and the latter is set in motion while successive sheet-bearing grippers 9 of the conveyor 8 open to deposit successive sheets P on top of the preceding sheets and to thus form on the conveyor 10 a fresh scalloped stream which is transported to a processing station, e.g., to a gathering machine. The speed of the conveyor 10 during transfer of a complete section TS from the carrier portion 3*a* onto the upper reach of the conveyor 10 is preferably constant. The conveyors 8 and 10 are arrested as soon as the transfer of a complete section TS onto the conveyor 10 is completed, and the carrier 3 is then caused to advance by a step so as to move the right-hand marginal portions of sheets P in the next section TS into the range of opened grippers 9 which are adjacent to the right-hand side of the zone 6, as viewed in FIG. 1 or 2. The aforedescribed procedure is then repeated again and again so that the supply of sections TS in the magazine including the reel 2 is gradually exhausted while the length of the scalloped stream on the conveyor 10 increases accordingly. The arrangement may be such that the foremost sheet P of each next-following section TS partially overlaps the last sheet P of the preceding section TS on the conveyor 10, i.e., that the conveyor 10 accumulates and transports a continuous scalloped stream with no visible boundaries between successive sections of such stream. All this depends on the mode of synchronizing the movements of various conveyors in the improved apparatus. However, it is equally within the purview of the invention to form on the conveyor 10 a succession of discrete sections each of which contains a predetermined number of sheets P, preferably a number corresponding to that of sheets P in a section TS.

An important advantage of the improved apparatus is that its capacity greatly exceeds those of heretofore known apparatus employing a flexible band-like carrier even though the bulk of the improved apparatus hardly exceeds that of conventional apparatus. This is attributable to the provision of a carrier which can store a scalloped stream consisting of sections (rather than discrete sheets) of the original scalloped stream. Thus, the capacity of the improved apparatus to store sheets is a multiple of that of heretofore known apparatus due to the fact that the carrier 3 can store rows of transversely extending partially overlapping sheets. In other words, if the carrier is to temporarily store sections TS which form a scalloped stream of sections, the neighboring sheets which are stored between the windings 3*b* of the carrier 3 partially overlap each other as considered in the longitudinal as well as in the transverse direction of the carrier. The provision of a sheet transferring conveyor (8) which can be raised and lowered so that it can transfer sections TS from the conveyor 7 onto the carrier section 3*a* or from the zone 6 onto the conveyor 10 also contributes to versatility, compactness and simplicity of the improved apparatus.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A method of temporarily storing the sheets of a stream of partially overlapping sheets having a first width between the windings of a flexible carrier which has a second width, is convoluted on a first reel and has a leader connected to a second reel, said method comprising the steps of:

(a) transporting the stream lengthwise along a predetermined path;

(b) transferring from said path successive stream sections, each of which has a length no greater than matching said second width and each of which contains a plurality of partially overlapping sheets, onto the carrier retaining said partial overlapping between the first and second reels the transferring step being performed in such a manner that each stream section extends transversely of the carrier; and (c) advancing the carrier stepwise in a direction towards the second reel upon transfer of successive sections of the stream so that the carrier is wound onto the second reel and the sections of the stream are confined between the neighboring windings of the carrier.

2. The method of claim 1, wherein said advancing step comprises moving the carrier through increments of a length no greater than equal to the first width so that successively transferred sections of the stream partially overlap each other on the carrier retaining said partial overlapping.

3. The method of claim 1, wherein the predetermined path is at least substantially horizontal and further comprising the step of maintaining a portion of the carrier between the first and second reels in a substantially horizontal plane at a level below said path.

4. The method of claim 1 further comprising the steps of moving the carrier stepwise in a direction from the second toward the first reel, and removing successive sections from the carrier between the first and second reels during the intervals between successive stepwise movements of the carrier in the direction from the second toward the first reel.

5. The method of claim 1, wherein said predetermined path extends transversely of the carrier between the first and second reels.

6. The method of claim 1, further comprising the step of maintaining a portion of the carrier between the first and second reels in a substantially hroizontal plane; and wherein the removing step comprises transporting the removed sections away from the carrier along another path disposed below said plane.

7. The method of claim 6, wherein said other path extends transversely of the carrier.

8. Apparatus for temporarily storing the sheets of a stream of partially overlapping sheets each of which has a first width, said apparatus comprising:

(a) a first and a second reel;

(b) an elongated flexible carrier having a second width and including first and second end portions connected to the respective reels so that the carrier is wound onto the second reel when the first and second reels are rotated in directions to respectively pay out and collect the carrier;

(c) conveyor means arranged to transport the stream lengthwise along a predetermined path;

(d) means for transferring successive stream sections, each of which has a length no greater than equal to the width of the carrier and each of which contains a plurality of partially overlapping sheets from said path onto the carrier retaining said partial overlapping between said reels, said transferring means being designed such that each stream section is deposited on the carrier so as to extend transversely of the latter; and (e) means for advancing the carrier stepwise between the transfer of successive sections of the stream and in a direction from the first towards the second reel so that the carrier is wound onto the second reel and the sections of the stream are confined between the neighboring windings of the carrier.

9. The apparatus of claim 8, wherein said predetermined path extends transversely of the carrier between said reels.

10. The apparatus of claim 8, further comprising guide means defining for the carrier a second path intermediate said reels at a level below the path of the stream.

11. The apparatus of claim 8, wherein said transferring means comprises second conveyor means extending substantially transversely of the carrier between said reels.

12. The apparatus of claim 11, wherein said second conveyor means has a length at least matching the width of the carrier.

13. The apparatus of claim 11, wherein said second conveyor means comprises at least one pair of open-and-shut grippers for each sheet of a section of the stream.

14. The apparatus of claim 13, wherein said second conveyor means is adjacent to that side of said path which is remote from the second reel.

15. The apparatus of claim 11 further comprising guide means defining for a portion of said carrier an additional path which is disposed between said reels at a level below said predetermined path, said second conveyor means being arranged to deposit sections onto the carrier portion in said additional path; and further comprising sheet removing conveyor means disposed at a level below said additional path, said second conveyor means being arranged to transfer sections of the stream from said additional path onto said removing conveyor means in response to stepwise unwinding of the carrier from said second reel.

16. The apparatus of claim 8, wherein said advancing means includes means for moving the carrier through increments each having a length at most matching the width of a sheet so that the successively transferred sections of the stream partially overlap each other on said carrier.

17. The apparatus of claim 8, wherein the carrier contains elastomeric material and is extensible and contractible in the longitudinal direction thereof.

* * * * *